US007173208B2

(12) United States Patent
Harada et al.

(10) Patent No.: US 7,173,208 B2
(45) Date of Patent: Feb. 6, 2007

(54) VACUUM INTERRUPTER

(75) Inventors: Takakazu Harada, Tokyo (JP); Hiromi Koga, Tokyo (JP); Shinichi Miki, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/105,396

(22) Filed: Apr. 14, 2005

(65) Prior Publication Data

US 2006/0124600 A1 Jun. 15, 2006

(30) Foreign Application Priority Data

Dec. 10, 2004 (JP) ..... 2004-358645

(51) Int. Cl.
*H01H 33/66* (2006.01)

(52) U.S. Cl. ..... 218/123; 218/118; 218/127

(58) Field of Classification Search ..... 218/118, 218/123–129, 146, 10, 16, 17
See application file for complete search history.

(56) References Cited

U.S. PATENT DOCUMENTS 3,764,764 A * 10/1973 Takasuna et al. ..... 218/127
3,946,179 A * 3/1976 Murano et al. ..... 218/129
4,584,445 A * 4/1986 Kashiwagi et al. ..... 218/130
4,588,879 A * 5/1986 Noda et al. ..... 218/127
5,495,085 A * 2/1996 Yorita et al. ..... 218/123
5,777,287 A * 7/1998 Mayo ..... 218/123
6,437,275 B1 * 8/2002 Kikuchi et al. ..... 218/123
6,479,778 B1 * 11/2002 Kimura et al. ..... 218/118
2003/0010752 A1 * 1/2003 Kikuchi et al. ..... 218/123

FOREIGN PATENT DOCUMENTS

JP 11-016456 1/1999
JP 2004-039432 2/2004

* cited by examiner

*Primary Examiner*—Elvin Enad
*Assistant Examiner*—M. Fishman
(74) *Attorney, Agent, or Firm*—Buchanan Ingersoll & Rooney PC

(57) ABSTRACT

A vacuum interrupter for reducing contact resistance and thereby reducing electromagnetic repulsive force between electrodes, is obtained. The vacuum interrupter includes a stationary electrode rod fixedly placed on one closed end of a cylindrical evacuated envelope closed at both ends thereof; a movable electrode rod movably placed on the other closed end; disc shaped contacts placed on opposing ends of the electrode rods; and reinforcement members for reinforcing the contact placed between each electrode rod and the associated contact. In such a configuration, a coefficient of linear expansion of the reinforcement member differs from that of the contact, and the reinforcement member and the associated contact are jointed by soldering at a plurality of opposing parts thereof.

10 Claims, 7 Drawing Sheets

VACUUM INTERRUPTER

BACKGROUND OF THE INVENTION

1. Field of the Invention

The present invention relates to a vacuum interrupter, and more particularly concerns an electrode configuration thereof.

2. Description of the Related Art

A vacuum interrupter includes a cylindrical evacuated envelope closed at both ends thereof, made of an insulation material such as glass or ceramic and evacuated inside at high vacuum; electrode rods respectively arranged on both closed ends of the evacuated envelope; spiral-ring-shaped coil electrodes provided on the opposing ends of the electrode rods; disc shaped contacts; and reinforcement members for reinforcing the contacts, wherein one of the electrode rods is moved in the axial direction so as to bring both contacts (namely, a stationary contact and a movable contact) into and out of contact with each other, thereby turning electric current on and off.

In the vacuum interrupter described above, a magnetic field in the axial direction is generated by the electric current and an electric arc inevitably produced between the contacts during interrupting operation is trapped within the diameter of the contacts, whereby thermoelectron and metal vapor produced by the arc converge within the contacts.

For example, as shown in Japanese Unexamined Patent Application Publication No. 11-16456, FIG. 7 is a partially sectional side view showing a configuration of an essential part of a conventional vacuum interrupter, and FIG. 8 is an exploded perspective view showing one electrode assembly of the conventional vacuum interrupter. Referring to Figures, reference numerals 1, 1 denote two electrode assemblies arranged in opposed relationship, each of the electrode assemblies 1 includes an electrode rod 11 placed on one closed end of an evacuated envelope not shown; a spiral-ring-shaped coil electrode 12 having a ring shaped holding part 12*a*, a part of which is inserted by an opposing end of the electrode rods 11; a pin shaped reinforcement member 13 having an end inserted into the holding part 12*a*; and a disc shaped contact C whose rear face is in contact with the coil electrode 12 and the reinforcement member 13, wherein respective axle centers of the electrode assemblies coincide with each other.

The coil electrode 12 has a plurality of arm parts 12*b*, which are integrally formed in radial directions from the ring shaped holding part 12*a* into which an end 11*a* of the electrode rod 11 is inserted. Each end of the respective arm parts 12*b* extends in the same direction along the circumference to form arcuate part 12*c*. In addition, each end of the respective arcuate parts 12*c* protrudes in the direction opposing to the contact C to form a joint part 12*d*, and thus the respective joint parts 12*d* are brought into contact with the associated contact C.

In a vacuum interrupter for interrupting a heavy-current, an electric arc is produced between the contacts C, C during interrupting operation and currents due to the arc do not flow in the reinforcement members 13, 13 which are made of high resistance material such as stainless steel, but flow to the electrode rods 11, 11 through the coil electrodes 12, 12 which are made of conductive material. The currents flow in the contacts C, C in radial directions. After that, each of the respective currents flows from the joint parts 12*d* to the coil electrode 12. The current passes the arcuate parts 12*c*, the arm parts 12*b*, the holding part 12*a*, and the electrode rod 11 in order. Consequently, four fan-shaped current paths are formed, and vertical magnetic fields (magnetic fields in the axial direction) of the electrode assemblies 1, 1 are generated in these fan-shaped current paths by the known right-handed screw rule.

As described above, by effectively generating the vertical magnetic fields, the arc which otherwise would be diffused in the evacuated envelope converges within the diameter of the contacts C, C. The arc is not concentrated on the contacts C, C, but diffused on the opposed entire surfaces of the contacts C, C, thereby significantly improving interruption characteristic.

Contact resistance between the stationary contact and the movable contact of the vacuum interrupter is largely affected by a state of contact between the contacts and has large irregularities. The reason is that even if a contact shape is plane, the state of contact between the contacts during closing operation of the vacuum interrupter represents point contact from a micro view-point, because the contact resistance varies in accordance with contact positions, contact areas, or the number of contact points. Particularly in the coil electrode, i.e., in the vacuum interrupter with the vertical magnetic field electrode structure, a current flowing from the electrode rod flows to the contact through the coil electrode, thereby tending to increase contact resistance.

Further, when a large current is applied to the vacuum interrupter, an electromagnetic repulsive force acts between the contacts of the vacuum interrupter. If an external applying force exerted on the vacuum interrupter, when applied current, is smaller than the electromagnetic repulsive force, an electric arc may be produced. The electromagnetic repulsive force is also largely affected by contact positions, contact areas, or the number of contact points between the contacts. If the vacuum interrupter produces an electric arc, chances of deposition of the contacts are high. There arises a problem in that a large external applying force is required so as not to produce an electric arc, and consequently configuration of interrupters or switchgear etc. becomes large.

SUMMARY OF THE INVENTION

The present invention has been made to solve the problem described above, and has an object to provide a vacuum interrupter which brings a stationary contact and a movable contact into contact with each other at a plurality of contact points during closing operation of the vacuum interrupter to reduce contact resistance, thereby reducing electromagnetic repulsive force between the electrodes.

The vacuum interrupter according to the present invention includes a stationary electrode rod fixedly placed on one closed end of a cylindrical evacuated envelope closed at both ends thereof; a movable electrode rod movably placed on the other closed end; disc shaped contacts placed on opposing ends of the electrode rods; and reinforcement members for reinforcing the contact placed between each electrode rod and the associated contact. In such a configuration, a coefficient of linear expansion of the reinforcement member differs from that of the contact, and the reinforcement member and the associated contact are jointed by soldering at a plurality of opposing parts thereof.

The vacuum interrupter according to another aspect of the present invention includes a stationary electrode rod fixedly placed on one closed end of a cylindrical evacuated envelope closed at both ends thereof; a movable electrode rod movably placed on the other closed end; ring shaped coil electrodes placed on opposing ends of the electrode rods, for generating, when energized, magnetic fields in the axial direction of the electrode rods; disc shaped contacts placed on opposing ends of the coil electrodes; and reinforcement members placed between each coil electrode and the associated contact. In such a configuration, a coefficient of linear expansion of the reinforcement member differs from that of the contact, and the reinforcement member and the associated contact are jointed by soldering at a plurality of opposing parts thereof.

According to the vacuum interrupter of the present invention, a coefficient of linear expansion of the reinforcement member differs from that of the contact, and the reinforcement member and the associated contact are jointed by soldering at a plurality of opposing parts thereof, resulting in producing concavities and convexities on the contact surface. Consequently, a vacuum interrupter is provided in which the movable contact is brought into contact with the stationary contact stably at a plurality of contact points during closing operation of the vacuum interrupter, whereby contact resistance can be reduced and therefore electromagnetic repulsive force between the electrodes can be reduced.

The foregoing and other objects, features, aspects and advantages of the present invention will become more apparent from the following detailed description of the present invention when taken in conjunction with the accompanying drawings.

DETAILED DESCRIPTION OF THE INVENTION

First Embodiment

Figure 1:
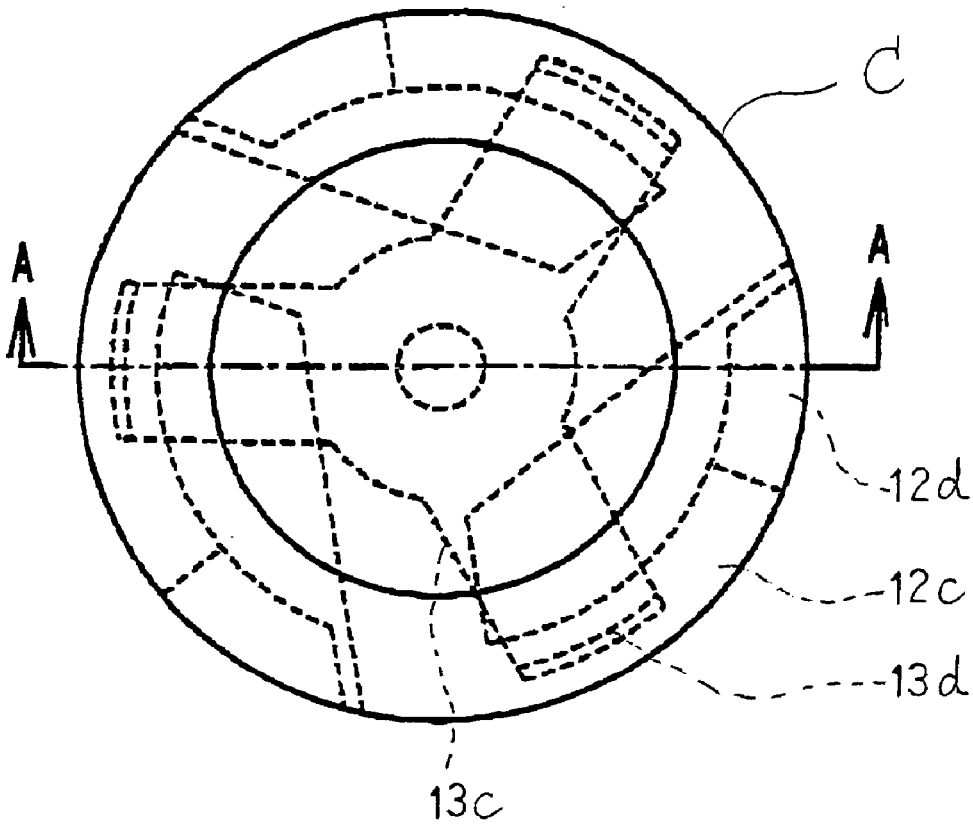
FIG. 1 is a front view showing a contact of a vacuum interrupter in a first embodiment according to the present invention.
Figure 2:
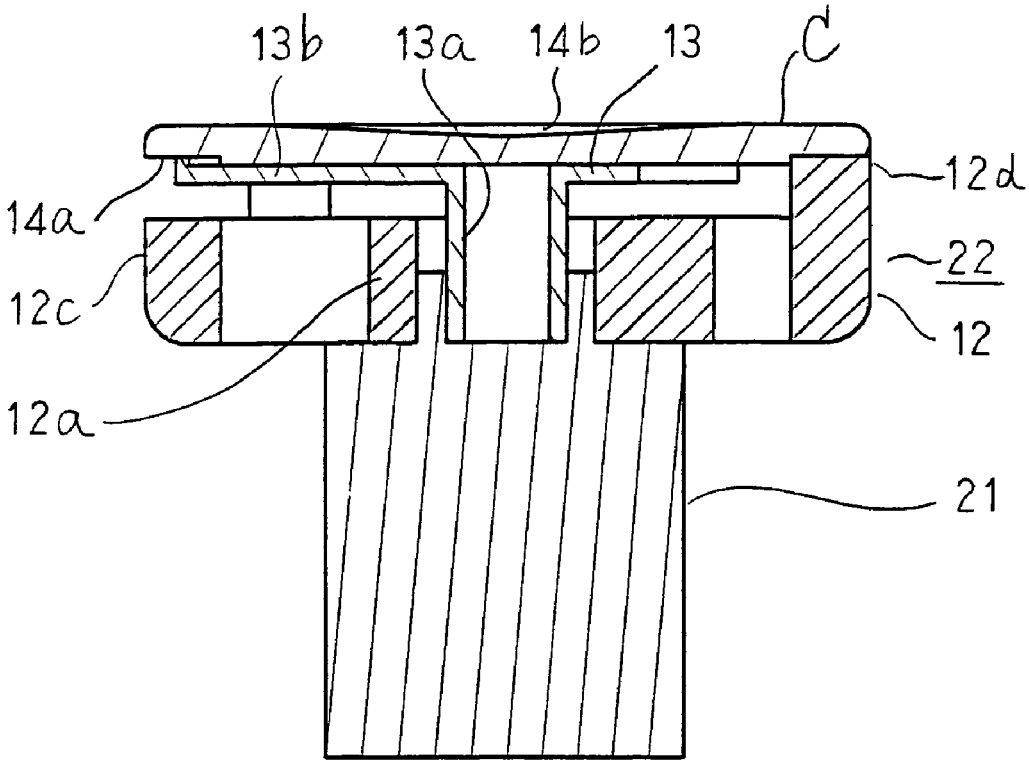
FIG. 2 is a cross-sectional view taken along the line A—A of FIG. 1, showing one electrode assembly of the vacuum interrupter.
Figure 3:
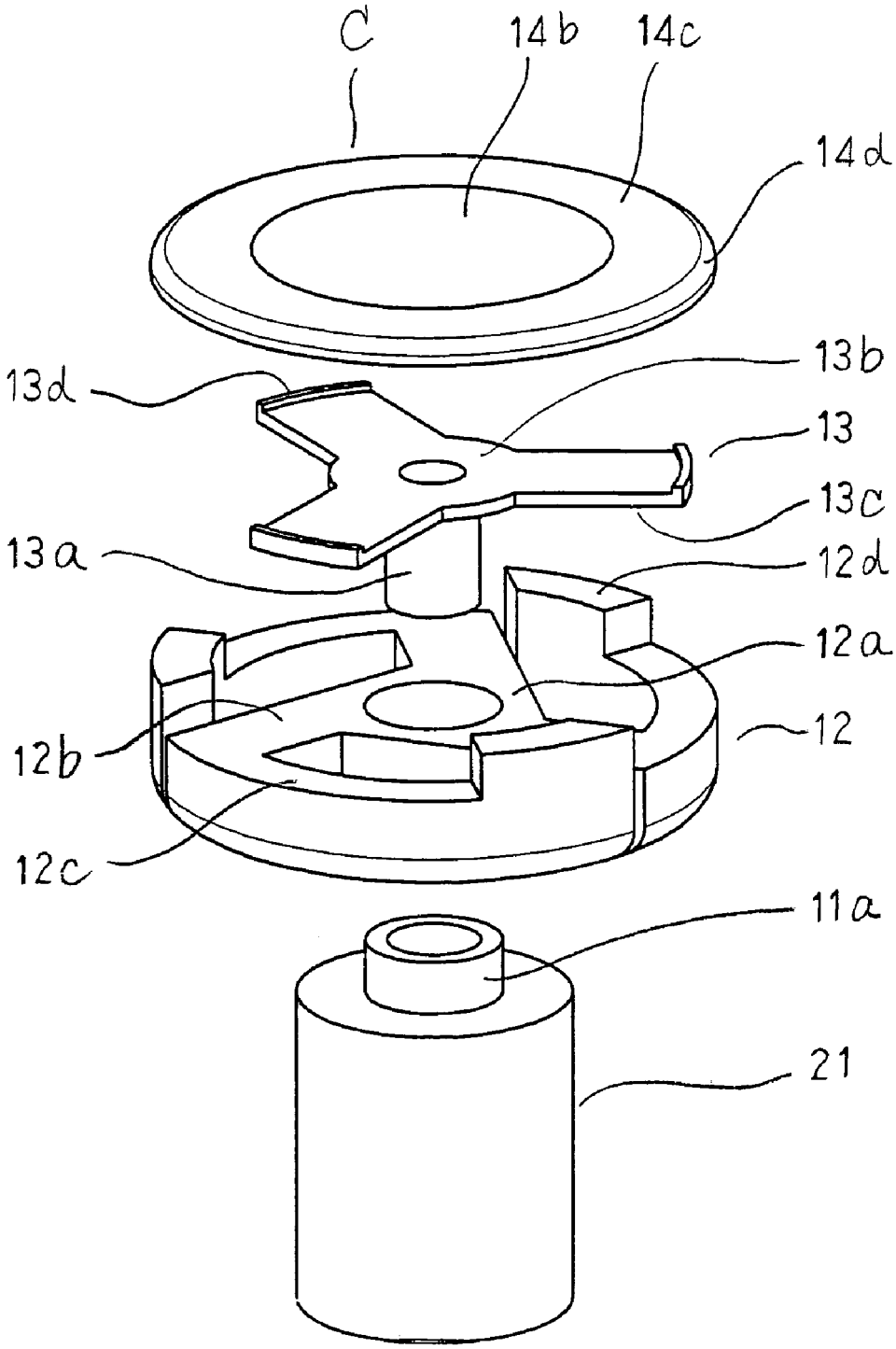
FIG. 3 is an exploded perspective view of FIG. 2, showing one electrode assembly.
Figure 4:
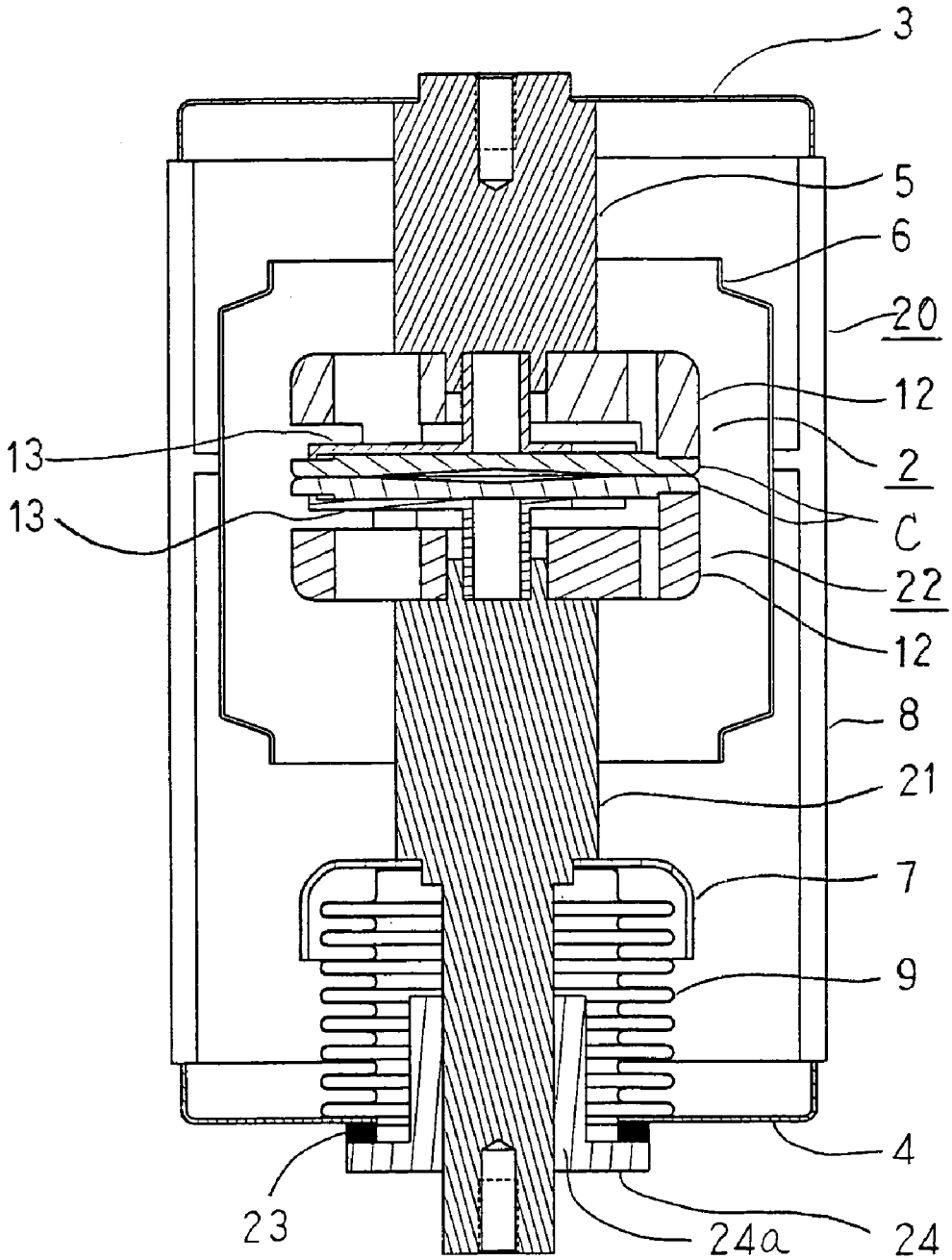
FIG. 4 is a cross-sectional view of the vacuum interrupter in the first embodiment according to the present invention.
Figure 7:
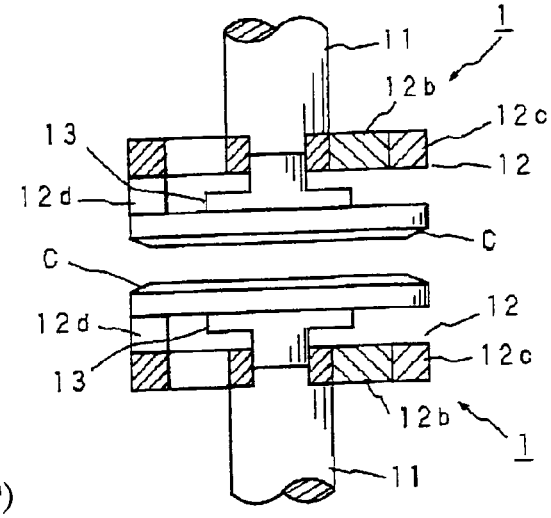
Fig. 7 (PRIOR ART)
FIG. 7 is a partially sectional side view showing an essential part of a conventional vacuum interrupter.
Figure 8:
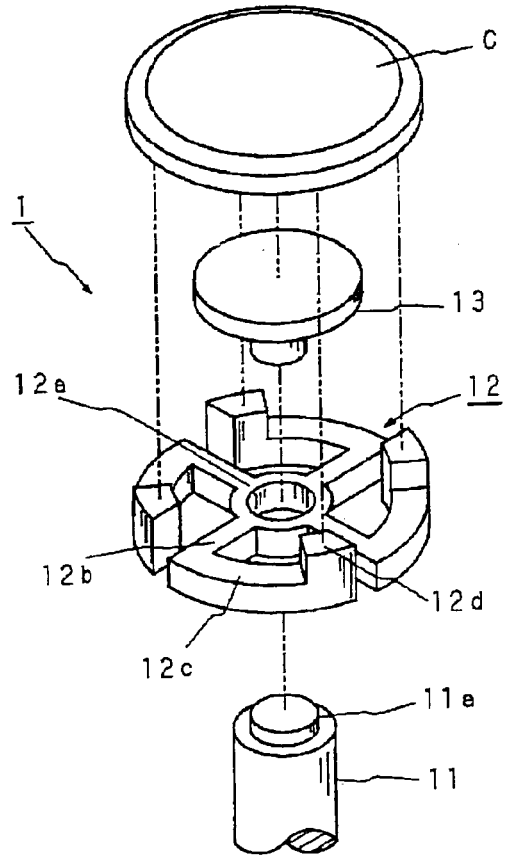
Fig. 8 (PRIOR ART)
FIG. 8 is an exploded perspective view showing one electrode assembly of the conventional vacuum interrupter.

FIG. 4 is a cross-sectional view of a vacuum interrupter in a first embodiment according to the present invention. FIG. 1 and FIG. 2 show one electrode assembly of the vacuum interrupter, and FIG. 1 is a front view showing a contact. FIG. 2 is a cross-sectional view taken along the line A—A of FIG. 1. FIG. 3 is an exploded perspective view of FIG. 2, showing one electrode assembly 3. In addition, referring to Figures, those portions which are given the same reference characters as given in FIG. 7 and FIG. 8 indicate that they are identical or equivalent to the parts in FIG. 7 and FIG. 8, and their description will be partly omitted.

Referring to FIG. 4, a cylindrical evacuated envelope 20 closed at both ends thereof, includes a stationary side end plate 3 and a movable side end plate 4, both of which are hermetically placed by soldering on both ends of a cylindrical insulating container 8 made of glass, alumina ceramic etc. The evacuated envelope 20 is evacuated inside at a vacuum of approximately $10^{-2}$ Pa and below. A stationary electrode rod 5 is mounted in the stationary side end plate 3 so as to extend therethrough, arranged coaxially along the evacuated envelope 20, and hermetically fixed to the stationary side end plate 3 by soldering. A stationary electrode 2 is arranged in the axial direction at one end of the stationary electrode rod 5 which extends in the evacuated envelope 20. The stationary electrode 2 includes a disc shaped stationary contact C, a ring shaped stationary coil electrode 12 for producing vertical magnetic fields, and a reinforcement member 13 for reinforcing the associated contact.

A movable electrode rod 21 is mounted in the movable side end plate 4 so as to extend therethrough, arranged coaxially along the evacuated envelope 20, and hermetically fixed to the movable side end plate 4 by soldering through a bellows 9. A movable contact 22 is arranged in the axial direction at one end of the movable electrode rod 21 which extends in the evacuated envelope 20 so that the movable contact 22 opposes to the stationary electrode 2. The movable contact 22 includes the disc shaped movable contact C, the ring shaped movable coil electrode 12 for producing vertical magnetic fields, and the reinforcement member 13 for reinforcing the associated contact. The bellows 9 made of thin stainless steel enables the movable electrode rod 21 to move while maintaining vacuum tightness, whereby the movable contact 22 is permitted to come into and out of contact with the stationary electrode 2.

A shield 6 is arranged in a manner of covering an inner wall surface of the insulating container 8 and a bellows shield 7 is arranged in a manner of covering the bellows 9, and therefore the inner wall surface of the insulating container 8 and the bellows 9 are prevented from contamination with metal vapor produced due to an electric arc. In addition, a guide mounting plate 23 is fixed to the movable side end plate 4. After the completion of the vacuum interrupter assembly by soldering, a resin guide 24, which guides movement of the movable electrode rod 21, has a cylindrical flange 24*a* through which an extended part of the movable electrode rod 21 is inserted. The resin guide 24 is fixed to the guide mounting plate 23 with screws etc.

Next, a configuration on the electrode side of the movable electrode rod 21 and the movable contact 22 will be specifically described with reference to FIG. 1 to FIG. 3. However, since the electrode side of the stationary electrode rod 5 and the stationary electrode 2 are similar in configuration, description thereof will not be repeated. The movable contact 22 includes the spiral-ring-shaped coil electrode 12 having a ring shaped holding portion 12*a* which is inserted by an end of the movable electrode rod 21, the end being faced to the stationary electrode rod 5; the pin-shaped reinforcement member 13 having an end which is inserted into the movable electrode rod 21; and the disc shaped contact C whose rear face is in contact with the coil electrode 12 and the reinforcement member 13, wherein respective axle centers of the coil electrode 12, the reinforcement member 13, and the contact C coincide with each other.

A ring shaped cylindrical part 11*a* is provided on the end of the movable electrode rod 21, the end being faced to the stationary electrode rod 5, and an outer circumference of the cylindrical part 11*a* is inserted into the ring shaped holding portion 12*a* of the coil electrode 12. Further, a central cylindrical part 13*a* of the reinforcement member 13 is inserted into an inner circumference of the cylindrical part 11*a*. The coil electrode 12 has a plurality of arm parts 12*b* which are integrally formed in radial directions from the ring shaped holding part 12*a* into which the cylindrical part 11*a* of the movable electrode rod 21 is inserted. Each end of the respective arm parts 12*b* extends in the same direction along the circumference to form arcuate part 12*c*. In addition, each end of the respective arcuate parts 12*c* protrudes in the direction opposing to the contact C to form a joint part 12*d*, and thus the respective joint parts 12*d* are brought into contact with the associated contact C.

The reinforcement member 13 has a disc shaped contact support part 13*b* which is extended in radial directions from the central cylindrical part 13*a* penetrated, and a plurality of projection parts 13*c* which are further extended in radial directions from the contact support part 13*b*. The projection parts 13*c* are equally spaced along the circumference, and three projection parts are provided in the first Embodiment. Each of the projection parts 13*c* has a teeth part 13*d* for soldering joint on the outer circumference end face along the entire length thereof, the teeth part 13*d* being opposed to the associated contact C. The reinforcement member 13 is made of stainless system material whose electric resistance is higher than that of the coil electrode 12 which is made of copper system material, thereby blocking a current from flowing through the reinforcement member 13.

The contact C has a cut part 14*a* formed on the outer circumference end face along the entire length thereof, the cut part 14*a* being opposed to the coil electrode 12 and the reinforcement member 13. The cut part 14*a* is jointed by soldering to the projection parts 13*c* of the reinforcement member 13, equally spaced along the circumference. The cut part 14*a* of the contact C electrically comes in contact with the joint parts 12*d* of the coil electrode 12. A face (surface) of the contact C of the movable electrode 22, the face being opposed to the contact C of the stationary electrode 2, includes a spot facing 14*b* formed at the central part; a ring shaped flat face 14*c* formed on the outer circumference side of the spot facing 14*b*; and a chamfering face 14*d* further formed on the outer circumference side of the ring shaped flat face 14*c*.

The contact C is made of copper system or silver system contact material, and coefficient of linear expansion thereof is 7 to $14\times10^{-6}$/K. The reinforcement member 13 is made of stainless system material etc., for example, the coefficient of linear expansion of austenitic stainless steel SUS304 is approximately $17\times10^{-6}$/K, which is larger than that of the material of the contact C.

The teeth parts 13*d* on the outer circumference end face of the respective projection parts 13*c* of the reinforcement member 13, are jointed by soldering to the cut part 14*a* of the associated contact C with silver solder at approximately 800° C., for example. When the reinforcement member 13 is made of material whose coefficient of linear expansion is different from that of the contact C, the contact C strains at the surface due to the difference in coefficient of linear expansion during cooling-down period after soldering. For example, when the reinforcement member 13 is made of material having a larger coefficient of linear expansion than that of the contact C, the reinforcement member 13 strains more than the contact C does. Consequently, at the soldering joint parts of the projection parts 13*c* of the reinforcement member 13 and the rear face of the associated contact C, the rear face of the contact C is pulled toward the reinforcement member 13, thereby producing dents at the contact surface (contact face between the contacts C, C) of the soldering joint parts of the contact C.

As shown in FIG. 3, when the projection parts 13*c* of the reinforcement member 13 are equally spaced along the circumference and the contact C is jointed to the projection parts 13*c*, the soldering joint parts are equally spaced along the circumference, thereby enabling to produce concavities and convexities evenly on the contact surface. At this time, where the spot facing 14*b* is formed on the central part of the contact, the concavities and convexities can be effectively produced in the ring shaped flat face 14*c* of the contact. Therefore, positions and the number of the contact points between the contacts C, C during closing operation of the vacuum interrupter can be easily controlled, and a plurality of contact points of the contact can be stably produced, whereby contact resistance can be reduced and stabilized, and electromagnetic repulsive force between the electrodes can be reduced.

As described above, when soldering positions between the reinforcement member 13 and the associated contact C are suitably selected, positions of the concavities and convexities produced on the contact face can be controlled. Consequently, a vacuum interrupter is provided in which the movable contact is brought into contact with the stationary contact stably at a plurality of contact points during closing operation of the vacuum interrupter, whereby contact resistance can be reduced and therefore electromagnetic repulsive force between the electrodes can be decreased.

In a vacuum interrupter for interrupting a heavy-current, an electric arc is produced between the contacts C, C during interrupting operation, and currents due to the arc do not flow in the reinforcement members 13, 13 which are made of high resistance material such as stainless steel, but flow to the stationary electrode rod 5 and the movable electrode rod 21 through, the coil electrodes 12, 12 which are made of conductive material. The currents flow in the contacts C, C in radial directions. After that, each of the respective currents flows from the joint parts 12*d* to the coil electrode 12. The current passes the arcuate parts 12*c*, the arm parts 12*b*, the holding part 12*a*, and the stationary electrode rod 5 or the movable electrode rod 21 in order. Consequently, three fan-shaped current paths are formed, and vertical magnetic fields (magnetic fields in the axial direction) of the stationary electrode 2 or the movable electrode 22 are generated in these fan-shaped current paths by the known right-handed screw rule.

By effectively generating the vertical magnetic fields, the arc which otherwise would be diffused in the evacuated envelope converges within the diameter of the contacts C, C. The arc is not concentrated on the contacts C, C, but diffused on the opposed entire surfaces of the contacts C, C, thereby significantly improving interruption characteristic.

Second Embodiment

Furthermore, a plurality of soldering joints of the reinforcement member and the associated contact, are preferable to be performed on both electrodes for the purpose of increasing the number of concavities and convexities on the surfaces of the contacts C, C. However, at least one of the reinforcement members and the associated contacts may be jointed by soldering at a plurality of opposing parts thereof, resulting in similar effectiveness.

Third Embodiment

Figure 5:
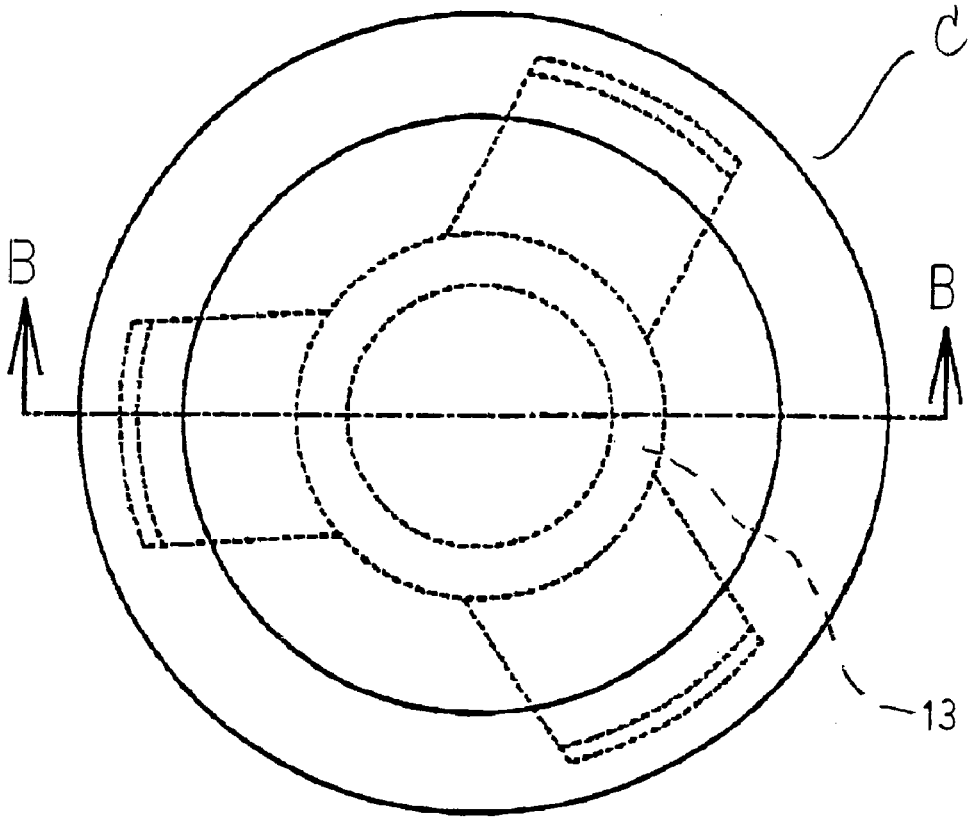
FIG. 5 is a front view showing a contact of a vacuum interrupter in a third embodiment according to the present invention.
Figure 6:
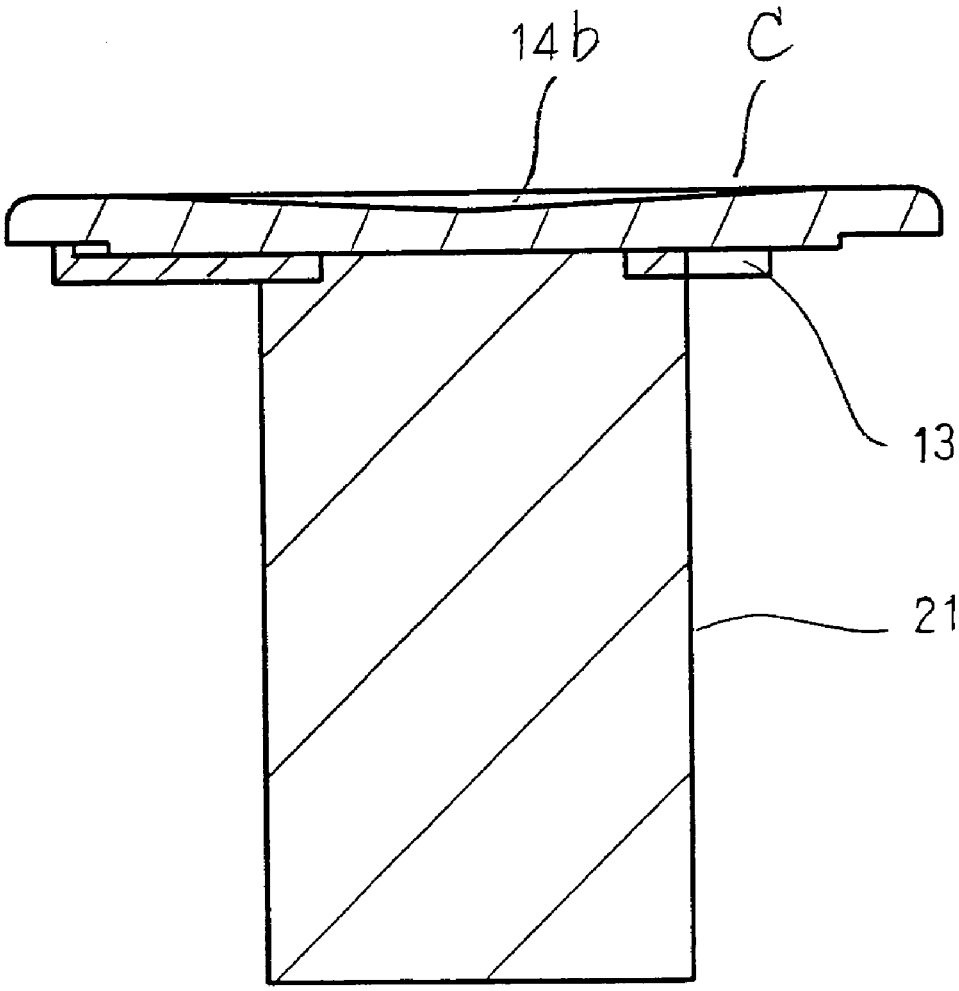
FIG. 6 is a cross-sectional view taken along the line B—B of FIG. 5.

FIG. 5 is a front view showing a contact of a vacuum interrupter in a third embodiment. FIG. 6 is a cross-sectional view taken along the line B—B of FIG. 5. The first embodiment describes the vacuum interrupter having the coil electrodes 12, 12; however, a vacuum interrupter having no coil electrodes 12, 12 may be provided, in which the stationary electrode rod 5 and the movable electrode rod 21 come in contact with the rear faces of the associated contacts C, C. The point is that a coefficient of linear expansion of the reinforcement member differs from that of the contact, and the reinforcement member and the associated contact are jointed by soldering at a plurality of opposing parts thereof. Consequently, concavities and convexities are produced on the contact surface, and a plurality of contact points of the contact can be produced, whereby contact resistance can be reduced and stabilized, and electromagnetic repulsive force between the electrodes can be reduced.

While the presently preferred embodiments of the present invention have been shown and described. It is to be understood that these disclosures are for the purpose of illustration and that various changes and modifications may be made without departing from the scope of the invention as set forth in the appended claims.

What is claimed is:

1. A vacuum interrupter comprising:

a stationary electrode rod fixedly placed on one closed end of a cylindrical evacuated envelope closed at both ends thereof;

a movable electrode rod movably placed on the other closed end;

disc shaped contacts placed on opposing ends of the electrode rods; and reinforcement members, each having a plurality of projection parts extending in radial directions and an outer circumference end face of each projection part being integral with a tooth part which is opposed to the associated contact, for reinforcing the contact placed between each electrode rod and the associated contact, wherein a coefficient of linear expansion of the reinforcement member differs from that of the contact, and the reinforcement member and the associated contact are jointed by soldering at the teeth parts provided on the outer circumference end face in the plurality of projection parts of the reinforcement member.

2. A vacuum interrupter comprising:

a stationary electrode rod fixedly placed on one closed end of a cylindrical evacuated envelope closed at both ends thereof;

a movable electrode rod movably placed on the other closed end;

ring shaped coil electrodes placed on opposing ends of the electrode rods, for generating, when energized, magnetic fields in the axial direction of the electrode rods;

disc shaped contacts placed on opposing ends of the coil electrodes; and reinforcement members placed between each coil electrode and the associated contact, each reinforcement member having a plurality of projection parts extending in radial directions and the outer circumference end face of each projection part being integral with a tooth part which is opposed to the associated contact, wherein a coefficient of linear expansion of the reinforcement member differs from that of the contact, and the reinforcement member and the associated contact are jointed by soldering at the teeth parts provided on the outer circumference in the plurality of projection parts of the reinforcement member.

3. The vacuum interrupter according to claim 1, wherein the coefficient of linear expansion of the reinforcement member is larger than that of the contact.

4. The vacuum interrupter according to claim 1, wherein the contact includes a spot facing formed on the central part thereof.

5. The vacuum interrupter according to claim 4, wherein the reinforcement member and the associated contact are jointed by soldering at the teeth parts provided on a same circumference of the outer circumference end face, opposing to the associated contact, in the plurality of projection parts which are extended in radial directions and equally spaced along the circumference of the reinforcement member.

6. The vacuum interrupter according to claim 5, wherein the reinforcement member and the associated contact are jointed by soldering at the teeth parts provided on the same circumference of the outer circumference end face, opposing to the associated contact, in the plurality of projection parts which are extended in radial directions and equally spaced along the circumference of the reinforcement member.

7. The vacuum interrupter according to claim 2, wherein the coefficient of linear expansion of the reinforcement member is larger than that of the contact.

8. The vacuum interrupter according to claim 2, wherein the contact includes a spot facing formed on the central part thereof.

9. The vacuum interrupter according to claim 5, wherein the teeth parts are respectively protruded in a ring-shape in the direction of the contact on the outer circumference end face, and are formed in the form of linear segments which are equally segmented in the circumference direction.

10. The vacuum interrupter according to claim 6, wherein the teeth parts are respectively protruded in a ring-shape in the direction of the contact on the outer circumference end face, and are formed in the form of linear segments which are equally segmented in the circumference direction.

* * * * *